United States Patent [19]

Bozek

[11] Patent Number: 4,955,354

[45] Date of Patent: Sep. 11, 1990

[54] ARCHERY DEVICE WITH CONSTRAINED FOUR-BAR LINKAGE

[76] Inventor: John W. Bozek, 6093 Waterfront Dr., Waterford, Mich. 48095

[21] Appl. No.: 321,104

[22] Filed: Mar. 9, 1989

[51] Int. Cl.[5] ..... F41B 5/00

[52] U.S. Cl. ..... 124/23.1; 124/25

[58] Field of Search ..... 124/24 R, 23 R, 23 A, 124/25, DIG. 1

[56] References Cited

U.S. PATENT DOCUMENTS

| | | | |
|---|---|---|---|
| 3,967,609 | 7/1976 | Frydenlund | 124/24 R |
| 3,981,290 | 9/1976 | Islas | 124/DIG. 1 |
| 4,287,867 | 9/1981 | Islas | 124/24 R |
| 4,603,676 | 8/1986 | Luoma | 124/DIG. 1 |
| 4,649,891 | 3/1987 | Bozek | 124/25 |
| 4,697,571 | 10/1987 | Waiser | 124/25 |
| 4,711,228 | 12/1987 | Gillespie | 124/25 |

*Primary Examiner*—Randolph A. Reese
*Assistant Examiner*—Anthony Knight
*Attorney, Agent, or Firm*—John R. Benefiel

[57] ABSTRACT

An archery device in which flexible limbs are supported on a limb holder by means of pairs of pivoted swing arms, the limbs, holder member and swing arm pairs each forming a four bar linkage system allowing the limbs to swing rearwards upon drawing of a connected drawstring. Load cables are connected to each limb tip which constrain the limb movement to cause flexing of the limbs during the draw. The load cables move towards alignment with the swing arms to reduce draw effort at full draw.

15 Claims, 3 Drawing Sheets

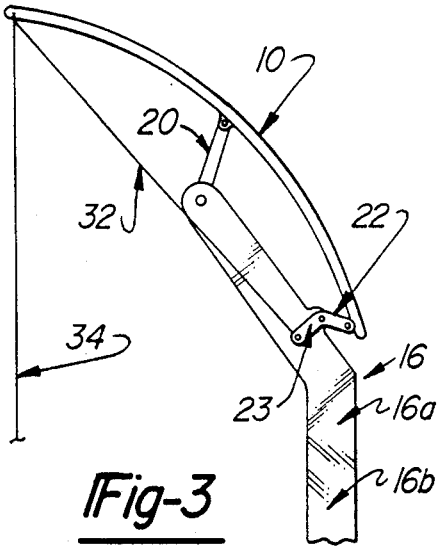
Fig-3
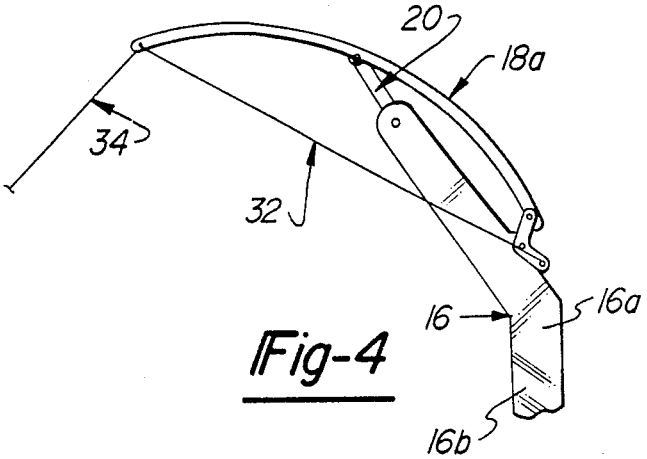
Fig-4
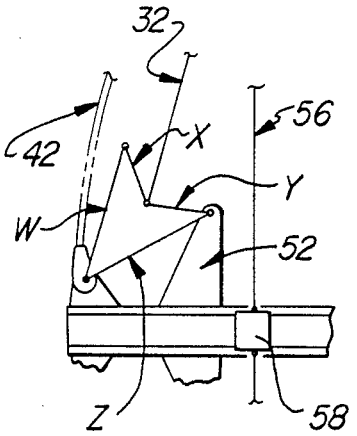
Fig-5A
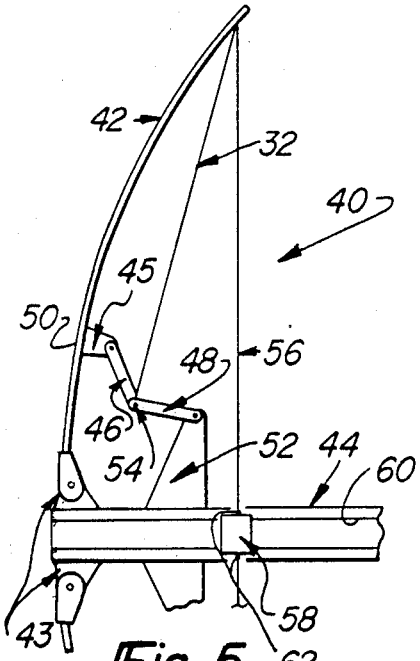
Fig-5
Fig-6
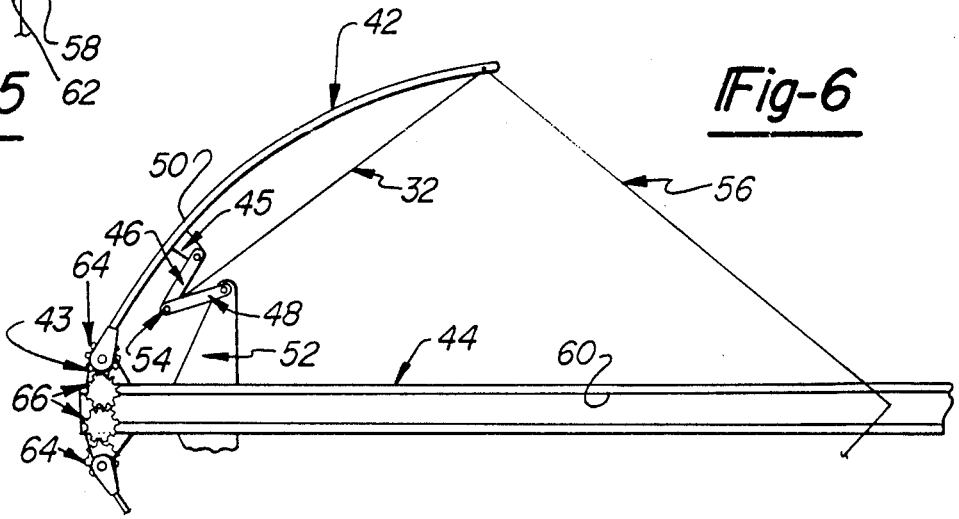

ARCHERY DEVICE WITH CONSTRAINED FOUR-BAR LINKAGE

BACKGROUND OF THE INVENTION

This invention concerns archery devices such as archery bows and crossbows in which the tips of flexibly bendable limbs are connected by a drawstring. Upon drawing of the drawstring with a projectile such as an arrow or bolt nocked to the midpoint, stored potential energy is generated, which is transferred to the arrow at firing to launch it into flight.

Maximum effort required is at full draw, limiting the stiffness of the bow able to be aimed accurately by an archer.

There has heretofore been developed so called "compound bows" using rotary elements or reels. These rotary elements, commonly called "cams" when they are non-circular and "wheels" when they are circular but mounted off-center, are used to reduce the effort required to hold the midpoint of the drawstring at full draw, and better aiming is possible from this reduction in effort. Such an archery bow is described by Allen, U.S. Pat. No. 3,486,495.

In Butler, U.S. Pat. No. 4,201,182, there is disclosed pivoting flexible limbs which are attached to a rigid handle. However, this arrangement still uses separate variable leverage devices, i.e., bell cranks to reduce the maximum effort required.

Another such arrangement is shown in U.S. Pat. No. 4,287,867 to Islas.

The span of a bow is determined to a large extent by the need to roughly match the draw distance able to be executed by the archer to the drawstring slack developed in bending the limbs to full draw. Such need results in a substantial span dimension for bows to prevent excessive limb bending and also finger pinching due to a too acute angle between the segments of the drawstring.

The Allen design and others using rotary elements do provide bowstring slack by unwinding of drawstring from the rotary elements to alleviate the above problem, but, as noted, this requires the separate rotary elements.

Accordingly, it is an object of the present invention to provide an archery device in which a reduction in drawstring resistance at maximum draw is achieved without the use of separate variable leverage devices.

It is a further object of the present invention to provide an archery device in which the span of the limb tips may be reduced without excessive limb bending or finger pinching, generating drawstring slack by an effect other than pure bending of the limbs and/or drawstring payout from rotary elements or other devices.

SUMMARY OF THE INVENTION

These and other objects which will become apparent upon a reading of the specifications and claims are accomplished by an archery device in which segments of a pair of flexibly bendable limbs and portions of a central limb holder forming an archery member are component parts of each of two sets of four-bar linkages at either end of said archery member, each four bar linkage in each set also incorporates two swing arms pivotally mounted into the linkage system. In one embodiment, the limb segments and the holder portions are opposite each other in the linkage system, and in another embodiment used in a crossbow, the limb segments and the holder portions are adjacent each other in the linkage system. In both types of constructions, the linkages carry the limb tips backward and toward each other, and the limb tips are constrained by attached load cables to cause a bending of the limbs and a progressive increase in displacement resistance when the linkages are forced rearwardly. As the load cables move towards alignment with the linkage components to which the cables are attached, a pronounced drop in displacement resistance occurs to achieve a drop in draw resistance at full draw without the use of variable leverage devices or any other type of add-on components. The load cables are attached either to the holder portions or to various pivoting elements to accentuate the limb flexing action. In one embodiment, the load cables wrap around fixed arced surfaces to effectively shorten the cables and shift their inclination to prevent moving overcenter.

Drawstring slack is generated by the displacement of the limb tips to enable short span limbs to be employed.

Various types of synchronizing systems are used to coordinate the bending of the limbs depending on whether the four-bar linkages are used in an archery bow or a crossbow construction.

DESCRIPTION OF THE DRAWINGS

FIG. 1 is a perspective fragmentary view of one side of the archery bow shown in FIG. 1.

FIG. 3 is a fragmentary side view of an alternate embodiment of an archery bow incorporating four bar linkages, shown in the rest or undrawn condition.

FIG. 4 is a fragmentary side view of the archery bow shown in FIG. 3 in the fully drawn condition.

FIG. 5 is a top fragmentary view of one side of a crossbow, shown in the rest or undrawn condition, that incorporates four-bar linkages according to the present invention.

FIG. 5A is an enlarged sectional view of the crossbow components comprising the four bar linkages with a superimposed diagrammatic representation of the four bar linkage system.

FIG. 6 is a fragmentary top view of one side of the crossbow shown in FIG. 5 shown in the fully drawn condition.

DETAILED DESCRIPTION OF THE PREFERRED EMBODIMENT

Figure 1:
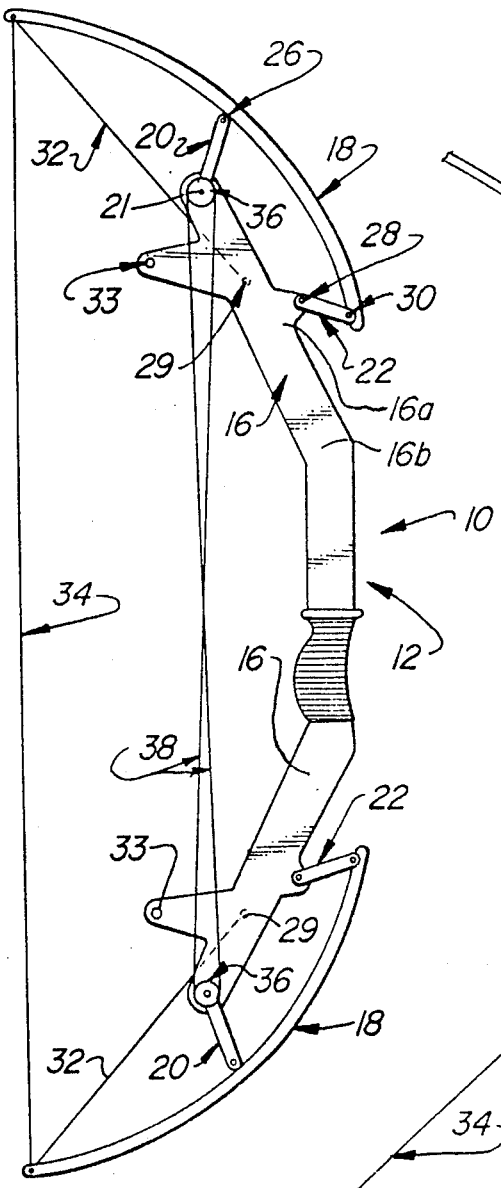
FIG. 1 is a side view of an archery bow construction, shown in the rest or undrawn condition, that incorporates four-bar linkages in which the limb segments and the handle portions are opposed components in the linkages.

Referring to FIG. 1, an example of an archery device according to the present invention is shown, here taking the form of a bow 10.

The bow 10 is formed by an archery member comprised of an elongated central limb holder member 12, formed with a hand grip 14. Extending from either end of the central holder member 12 is a respective rearwardly angled holder portion 16, comprised of spaced apart members 16a, 16b. Mounted between each member 16a, 16b is a respective limb 18 constructed of a flexible, moderately stiff material such as elongated flat pieces of metal, wood, or fiberglass.

Each limb 18 extends in a rearwardly angled direction partially overlapping the respective angled holder portion 16, and is swingably mounted thereon by a pair of intermediate swing arms 20 and a pair of forward swing arms 22, each pair pivotably supported at their inner ends to the holder member portion 16 and their outer ends to a respective limb 18. The inside end of each of the intermediate swing arms 20 is pinned at 21, to the angled portion 16 of the holder member 12.

The outer end of each swing arm 20 is pinned at an intermediate point 26 located along the length of the associated limb 18.

Each forward swing arm 22 has its inner end pinned at 28 to a holder portion 16 at a location spaced inward from the point 21 at which the intermediate arm 20 is pinned to the angled end 16.

The outer end of each forward swing arm 22 is pinned at 30 to the inner end of a respective limb 18.

Figure 1A:
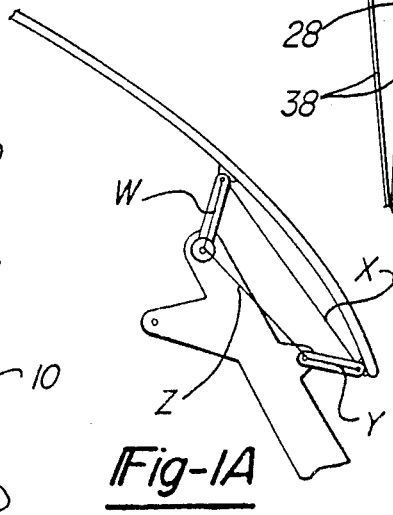
FIG. 1A is an enlarged fragmentary view of one side of the archery bow, with a superimposed diagrammatic indication of the four bar linkages.
Figure 1B:
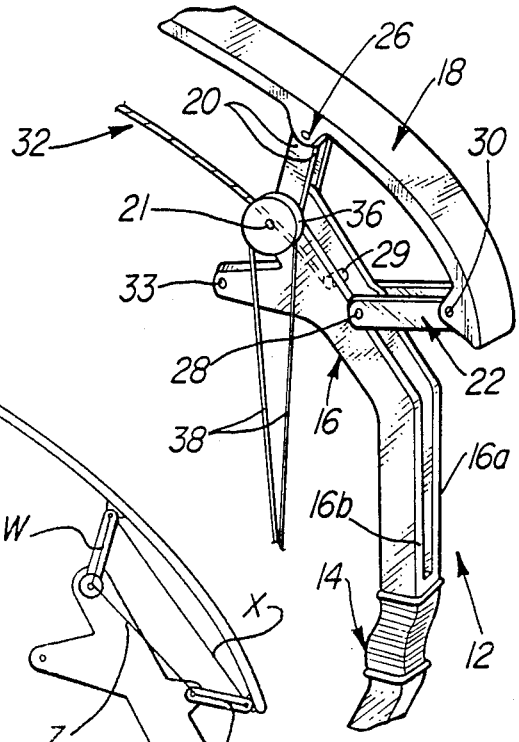

Thus, the four bar linkage systems outlined by the lines W,X,Y, and Z in FIG. 1A, are formed by the pairs of the intermediate and forward swing arms 20, 22, a segment of the associated limb 18, and a holder portion 16, allowing the limb 18 to swing on the holder portions 16 from an outward, forward position, to a retracted rearward position. In these linkages, the limb segment and the handle portion act as opposite side elements.

This movement of each limb 18 to the retracted, rearward position is restrained by a respective inextensible load cable 32 connected at one end to the outer tip of the limb 18 and at the other end to an anchor 29 on an angled holder portion 16 of the holder member 12.

Figure 2:
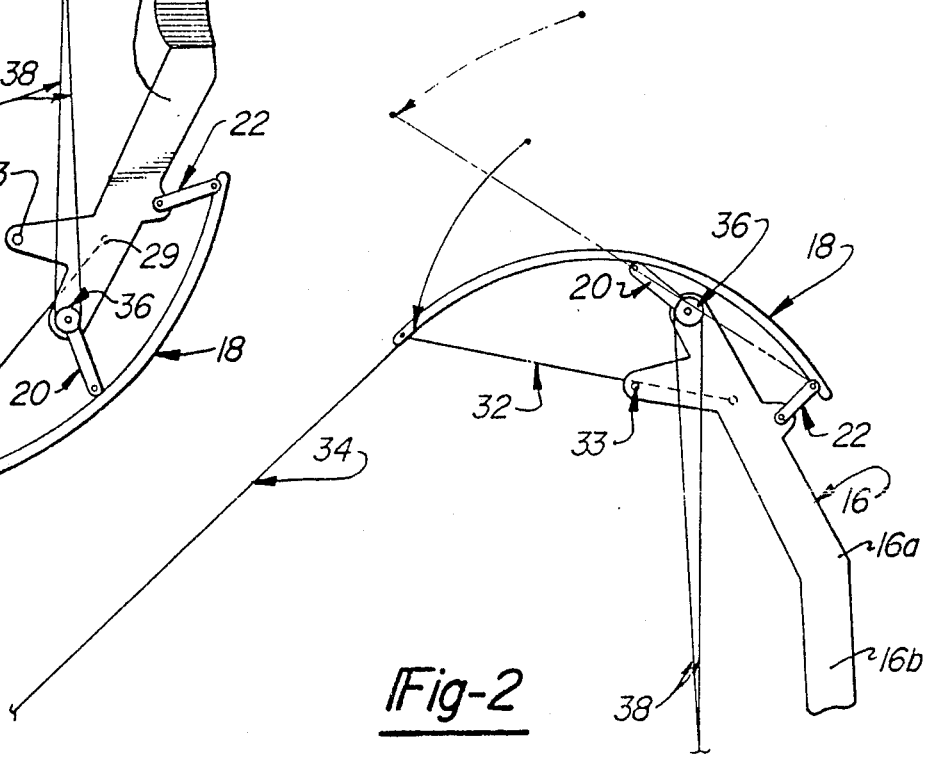
FIG. 2 is a fragmentary side view of the archery bow shown in FIG. 1 shown in the fully drawn condition.

The tip of each limb 18 moves about a point with an approximate constant radius in its rearward motion from the undrawn position, as indicated by the solid arc in FIG. 2. The movement of the limb tip when it is not constrained by the load cable 32 is indicated by the dotted arc.

The location of the anchor 29 must be selected to be located away from the approximate center of rotation of the outer tip of limb 18 in a direction towards the limb 18 so that the load cable 32 tends to constrain the tip of the limb 18 as the limb 18 swings rearwardly on the arms 20, 22. The motion of the end of the arm 22 also tends to draw the outer tip of the limb 18 towards its other end.

An inextensible drawstring 34 is connected at either end to a respective tip of a limb 18 to be drawn taut therebetween. As the midpoint of the drawstring 34 is drawn to the rear, the limbs 18 are caused to swing rearwardly on the arms 20, 22 until the load cables contact the limiter rods 33 extending between numbers 16a, 16b near the full draw point. Further rearward movement of the limbs as a result of force applied by the drawstring 34 results in the load cables 32 being bent around the limiter rods 33 and requires an increase in the required draw force and a change in the inclination of the load cables 32 to prevent movement past overcenter.

As a result of the constraining effect of the load cables 32, the limbs 18 are flexed by the shortening effect on the limbs 18 imposed thereon.

FIG. 2 illustrates that as the draw approaches maximum, the intermediate swing arms 20 approach an aligned position with the associated load cable 32. This causes a pronounced fall off in the effort required to hold the drawstring 34 in the fully drawn position, to produce the results of the "compound bow" without using rotary variable leverage devices.

In order to insure that equal movement of each limb 18 occurs, one intermediate swing arm 20 in each pair has a reel 36 fixed with which to rotate therein. Each reel 36 is drivingly connected to the other by a figure eight cable 38. This arrangement insures that synchronized corresponding movement of each limb 18 occurs, for reasons which will be well understood to those skilled in the art.

The release of the drawstring 34 will thus cause launching of an arrow or bolt (not shown) into flight as the flexed limbs 18 snap to the restored position.

FIG. 3 illustrates an alternate embodiment in which each of the load cables 32 are attached to an angled inner end 23 of a respective one of the forward swing arms 22. As is illustrated in FIG. 4, at the full draw point the load cables 32 align with the bent inner ends of the swing arms. This alignment results in a pronounced drop in the draw resistance.

This design may be preferred to that shown in FIGS. 1–3 for some applications because it reduces the possibility of interference between the load cables 32 and the axles on which the intermediate swing arms 20 rotate, and it reduces the need for the limiter rods 33 in FIG. 1.

FIG. 5 is an example of an archery device according to the present invention in the form of a crossbow 40. The butt ends of prod limbs 42 are pivotally attached on bracket 43 to attached sides of a stock 44. Two joined swing arms 46 and 48 connect a bracket 45 fixed at intermediate point 50 on each limb 42 to a bracket 52 mounted on each side of stock 44 and a load cable 32 connects the tip of each limb 42 to the joint 54 between the two pairs of swing arms 46 and 48. The tips of the limbs 42 are connected by drawstring 56.

Four bar linkages, indicated by lines W, X, Y, and Z in FIG. 5A, are comprised of a portion of the side of stock 44, a segment of limb 42, and the two pairs of joined swing arms 46, 48. In these linkages, the portion of the stock 44 and the segment of the limb 42 act as adjacent elements of the linkages.

FIG. 6 illustrates that as the draw progresses, the angle between the two pairs of swing arms becomes smaller until the two pairs of swing arms 46, 48 approach an overlapping condition. At this point, the required draw force drops to a fraction of its maximum value.

The synchronization of the movement of the limbs 42 can be obtained by various means. For example, in the construction shown in FIG. 5, synchronization is obtained by preventing any sideways movement of the drawstring 56. The midpoint of the drawstring 56 is maintained on the centerline of stock 44 by a slider 58 which slides in track 60 on top of stock 44. The drawstring 56 passes through slider 58 and stops 62 on the drawstring 56 prevent any lateral movement of the midpoint of the drawstring 56 at all times.

As shown in FIG. 6 the synchronization of limb movement can also be obtained by means of gears 64 shown attached to an inner end of a respective limb 42, and intermediate idler gears 66 mounted on the stock 44.

Figure 7:
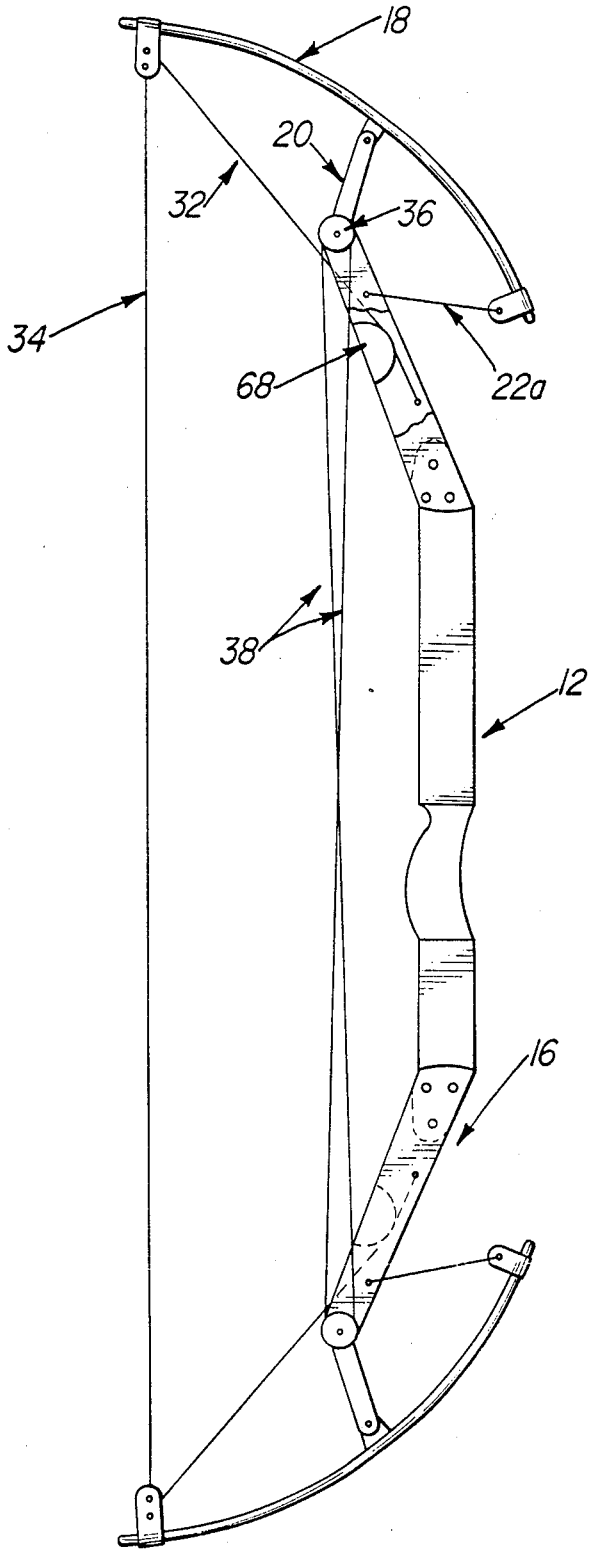
FIG. 7 is a side view of an alternate embodiment of the archery bow according to the present invention.

FIG. 7 illustrates another embodiment of the archery bow according to the present invention, in which each of the load cables 32 are attached at one end to a respective holder portion 16 of the holder member 12, and at the other to the tip of a respective limb 18.

A curved tension control block 68 is attached to each holder portion 16, around which a load cable is partially wrapped. As the drawstring 34 is drawn, the limbs 18 are swung rearwardly intermediate link 20 and forward link 22a (here provided by cable pairs). The load cables increasingly wrap about the anchor blocks 68 to smoothly and progressively shorten the load cables 32 and shift their inclination with respect to the tips of the limbs 18.

I claim:

1. An archery device comprising:

an elongated limb holder member having an end portion at either end thereof;

a handle on said holder member;

a pair of elongated bendable limbs each having opposite ends;

mounting means mounting each of said limbs to a respective end portion of said holder member, said mounting means including two pairs of pivoted swing arms each pair drivingly connected to a respective limb and a respective end portion of said holder member, each of said two pairs of swing arms and portions of said limbs and holder member forming four bar linkage systems;

said swing arms each pivotably supported at one end on one said end portion of said holder member and at the other end pivotably mounted to a respective limb;

a drawstring tautly connecting outboard ends of said limbs; and load cable means connected to the outboard end of each limb and including means restraining movement of each limb outboard end relative to said limb holder member, whereby as said drawstring is drawn, said limbs are caused to be swung to the rear, and said load cables causing flexing of said limbs as said limbs are swung to the rear by said constraining of said outboard ends thereof.

2. The archery device according to claim 1 further including synchronizing means drivingly connecting said limbs to cause synchronous swinging movement of each limb as said drawstring is drawn.

3. The archery device according to claim 2 wherein said synchronizing means includes a rotary element connected to rotate with one of each pair of arms of two opposite pairs of swing arms and synchronizing cable means extending about each rotary element to insure corresponding rotation of said rotary elements.

4. The archery device according to claim 1 wherein each swing arm in each pair is pivotably supported at one end on said respective end portion of said holder member and at the other end pivotably mounted to a respective limb.

5. The archery device according to claim 4 wherein one pair of said swing arms of each pair is pivotably connected to said respective limb at an intermediate point along the length thereof, and the other swing arm of each pair is pivotably supported adjacent the inboard end of said respective limb.

6. The archery device according to claim 1 wherein said load cable means includes inextensible cable lengths extending from the tip of each of said limbs to said limb holder member.

7. The archery device according to claim 1 wherein each of said load cables is directly fixed to a portion of said limb holder member.

8. The archery device according to claim 1 wherein each of said load cables is connected to ends of a respective one of said other swing arms.

9. The archery device according to claim 1 wherein each of said load cables are connected at a point off the center of rotation of the tip of a respective limb to restrain movement of said limb tip as said limbs swing rearward on said swing arms.

10. The archery device according to claim 1 wherein said swing arms move towards a position aligned with said load cables as said drawstring is drawn to a full draw position to thereby reduce the draw resistance necessary to be exerted at full draw.

11. The archery device according to claim 1 wherein said archery device comprises a cross bow having a stock comprising said holder member and wherein said swing arms are pivoted to each other at one end, and one of said swing arms in each pair is pivoted at its other end to said stock and the other swing arm in each pair is pivoted to said limb, each of said limbs pivoted at one end to one side of said stock.

12. The archery device according to claim 11 further including a slider mounted for sliding along said track and said drawstring is connected to said slider to synchronize movement of said limbs.

13. The archery device according to claim 1 wherein each load cable is connected to the pivotal connection between said swing arm pairs.

14. The archery device according to claim 11 wherein a gear train drivingly connects each of said limbs to cause each limb to rotate on said stock in synchronism with each other.

15. The archery device according to claim 1 further including a pair of anchor blocks, one mounted to each end portion of said holder member and each having a curved surface around which each load cable passes in extending to said outboard end of said cable.

* * * * *